United States Patent [19]

Brammer et al.

[11] Patent Number: 5,060,724

[45] **Date of Patent: * Oct. 29, 1991**

[54] CASING HANGER SEAL LOCKING MECHANISM WITH DETENT

[75] Inventors: Norman Brammer, Fivie Turriff, Scotland; Philippe C. Nobileau, Paris, France

[73] Assignee: Abb Vetco Gray Inc., Houston, Tex.

[ * ] Notice: The portion of the term of this patent subsequent to Aug. 21, 2007 has been disclaimed.

[21] Appl. No.: 552,442

[22] Filed: Jul. 13, 1990

Related U.S. Application Data

[63] Continuation-in-part of Ser. No. 336,012, Apr. 7, 1989, Pat. No. 4,949,787.

[51] Int. Cl.[5] ..... E21B 23/00; E21B 33/04

[52] U.S. Cl. ..... 166/208; 166/217; 285/140; 285/145; 285/338

[58] Field of Search ..... 166/208, 217, 135, 181, 166/182, 124, 86, 88; 285/140, 145, 146, 147, 331, 338, 342, 343, 348, 351

[56] References Cited

U.S. PATENT DOCUMENTS

| | | | |
|---|---|---|---|
| 4,521,040 | 6/1985 | Slyker et al. | 285/140 |
| 4,641,708 | 2/1987 | Wightman . | |
| 4,665,979 | 5/1987 | Boehm, Jr. | 166/208 |
| 4,678,209 | 7/1987 | Guice | 285/144 |
| 4,714,111 | 12/1987 | Brammer . | |
| 4,742,874 | 5/1988 | Gullion . | |
| 4,757,860 | 7/1988 | Reimert . | |
| 4,791,987 | 12/1988 | Cassity et al. | 166/85 |
| 4,815,770 | 3/1989 | Hyne et al. | 285/140 |
| 4,832,125 | 5/1989 | Taylor | 166/348 |
| 4,949,787 | 8/1990 | Brammer et al. | 166/208 |

*Primary Examiner*—William P. Neuder

*Attorney, Agent, or Firm*—James E. Bradley

[57] ABSTRACT

A casing hanger seal member has a locking section that will lock the seal member to the casing hanger and to the wellhead housing. The locking section includes a lower split ring that has serrations that will engage serrations on the exterior of the casing hanger. An energizing ring will force the split ring outward after the seal has set. The energizing ring also forces an upper split ring radially. The upper split ring has serrations that engage serrations formed in the bore of the wellhead housing. Tapered load shoudlers on the energizing ring and lower split ring transmit a downward force to assure that the seal member sets before the locking section actuates. A detent shoulder formed in the locking section and on the energizing ring will releasably lock the energizing ring in a lower, set position.

7 Claims, 2 Drawing Sheets

CASING HANGER SEAL LOCKING MECHANISM WITH DETENT

CROSS REFERENCE TO RELATED APPLICATION

This application is a continuation-in-part of Application Ser. No. 336,012, filed Apr. 7, 1989, now U.S. Pat. No. 4,949,787, Norman Brammer and Philippe C. Nobileau, entitled "Casing Hanger Seal Locking Mechanism".

BACKGROUND OF THE INVENTION

1. Field of the Invention

This invention relates in general to subsea wellhead equipment, and in particular to a casing hanger seal member having a mechanism for locking the seal in place.

2. Description of the Prior Art

In a subsea well of the type concerned herein, a wellhead housing will be located on the sea floor. Casing will extend into the well and be supported at the wellhead housing by a casing hanger. A seal or packoff locates between the casing hanger and the wellhead housing to seal this annulus space.

The casing seal is normally set by compression. The compressive force required can be quite high. One way in which to achieve this high compressive force is by using a nut and thread. Another method utilizes a hydraulic actuated running tool.

While both of these types are satisfactory, there are occasions when the wellhead pressures are not expected to be very high. If the seal did not require a very high compressive force for setting, a simpler running tool could be used.

Also, there are occasions when it is desirable to use a seal that could be easily retrieved along with the casing hanger. This occurs particularly when drilling an exploratory well. If the well is abandoned, at least part of the casing may be salvaged. If not abandoned, the seal could be retrieved and replaced with a more permanent seal. Consequently, there is a need for a remotely energized seal for a casing hanger that does not require complex running tools and which is easily retrieved.

SUMMARY OF THE INVENTION

In this invention, the casing hanger and the wellhead housing have serrations or wickers formed on them. The seal member has a seal section which locates below the serrations and which is sealed by compression. A locking section extends upward from the seal section.

The locking section has one wall which is substantially rigid. A split ring locates radially from the locking wall. The split ring has serrations positioned to engage the serrations on the casing hanger or on the wellhead.

An energizing ring is carried by the seal member with the lower portion located between the split ring and the locking wall. The energizing ring will move downward to push the split ring radially into locking engagement with the anchoring serrations.

The split ring has a tapered shoulder which mates with a tapered shoulder on the energizing ring when the energizing ring is in the upper position. These shoulders transmit downward force imposed on the energizing ring. The force transmits through the split ring and into the seal member to set the seal. Once the seal is set, the downward force causes the energizing ring shoulder to slip past the shoulder of the split ring to move the split ring to the locked position.

Also, the lower section of the energizing ring has a detent shoulder which will slide past and mate with a detent shoulder formed on an interior side of the locking wall. The detent shoulders interfere with each other as the energizing ring moves downward, locking the energizing ring in the lower position.

In the preferred embodiment, an upper split ring locates on top of the locking wall. The upper ring moves from a recessed position into engagement with serrations formed in the wellhead housing.

DESCRIPTION OF THE PREFERRED EMBODIMENT

Figure 1:
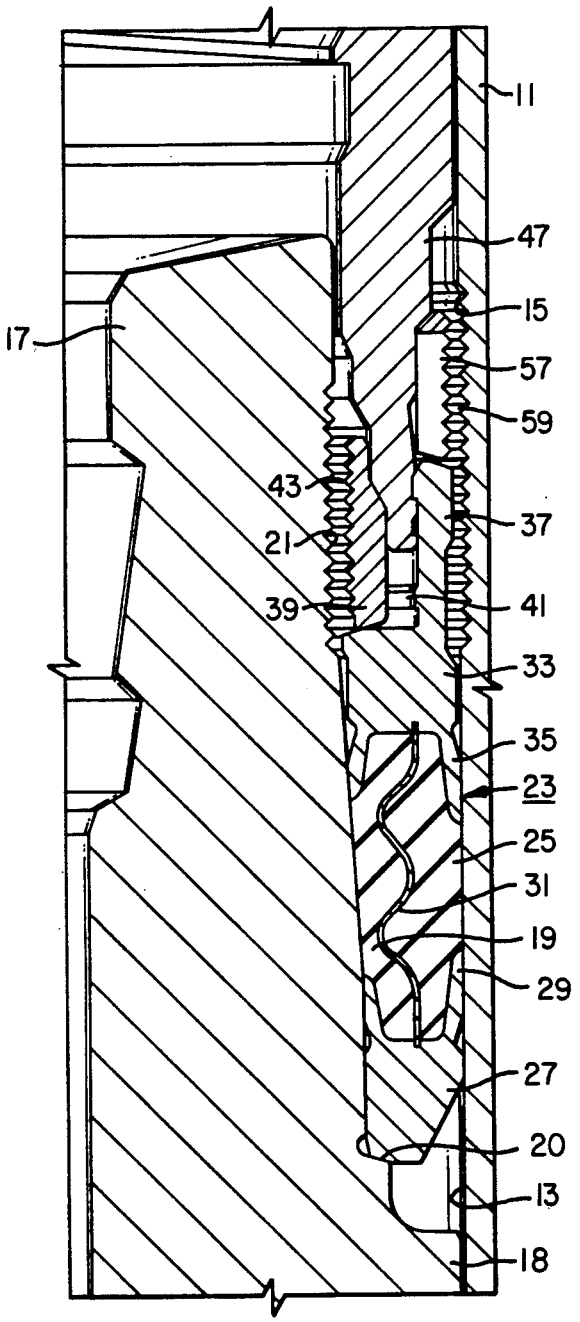
FIG. 1 is a cross sectional view illustrating a casing hanger seal locking member constructed in accordance with this invention, and shown in an upper position.

Referring to FIG. 1, the subsea well has a wellhead housing 11. Wellhead housing 11 will be located on the sea floor. A bore 13 extends through the wellhead housing 11. Bore 13 has a cylindrical portion containing a plurality of anchoring serrations 15. Serrations 15 are circumferential, parallel grooves extending completely around the bore 13. Each of the serrations 15, also called "wickers", is in a sawtooth configuration. Each of the serrations 15 has an upward facing flank and a downward facing flank. The flanks intersect each other at a 90 degree angle. The apex or junction of the flanks has an inner diameter that is the same as the inner diameter of bore 13.

A casing hanger 17 is conventionally supported within the bore 13 of wellhead housing 11. A string of casing (not shown) extends downward from the casing hanger 17. Casing hanger 17 has annular externally protruding band 18 and a tapered seal surface 19 located above band 18. Seal surface 19 is generally frusto-conical, having a larger diameter at the bottom than at the top. This results in a wedged-shaped annular cavity between the seal surface 19 and the wellhead housing bore 13. An upward facing shoulder 20 locates at the bottom of the seal surface 19.

A plurality of anchoring serrations 21 are formed on the exterior of casing hanger 17 above the seal surface 19. Serrations 21 are formed in a cylindrical portion of the casing hanger 17. Serrations 21 are positioned to be generally radially across from the serrations 15. Serrations 21 are identical in size and shape to the serrations 15, but do not extend as far up as the serrations 15.

A seal member 23 locates in the annular space between the wellhead housing 11 and the casing hanger 17. Seal member 23 has an elastomeric seal 25 in the preferred embodiment. Elastomeric seal 25 is of a type that is shown in U.S. Pat. No. 4,714,111, Norman Brammer, Dec. 22, 1987. A lower metal ring 27 locates on the bottom of the elastomeric seal 25. Lower ring 27 has a pair of metal sealing lips 29, which will expand outward to form a metal-to-metal seal. A metal linking member 31 is embedded within the seal 25 and is secured to the lower ring 27. Linking member 31 will deflect when the seal 25 is set. The linking member 31 extends upward to a metal upper ring 33. A pair of sealing lips 35 are located on the lower end of the upper ring 33 to form a metal-to-metal seal located above the elastomeric seal 25.

Upper ring 33 has an upward extending locking wall 37, which forms a part of a locking section. Locking wall 37 extends upward from an outer portion of the upper ring 33. Locking wall 37 is integrally formed with upper ring 33 and is substantially rigid.

The upper ring 33 supports on its upper end a lower split ring 39, which is part of the locking section. Lower split ring 39 is located radially inward from locking wall 37. An annular channel 41 separates the lower split ring 39 from the locking wall 37. A plurality of serrations 43 are located on the exterior of the lower split ring 39. Serrations 43 are of the same pitch and shape as serrations 21 to engage serrations 21 when in the locked position shown in FIG. 2.

Figure 2:
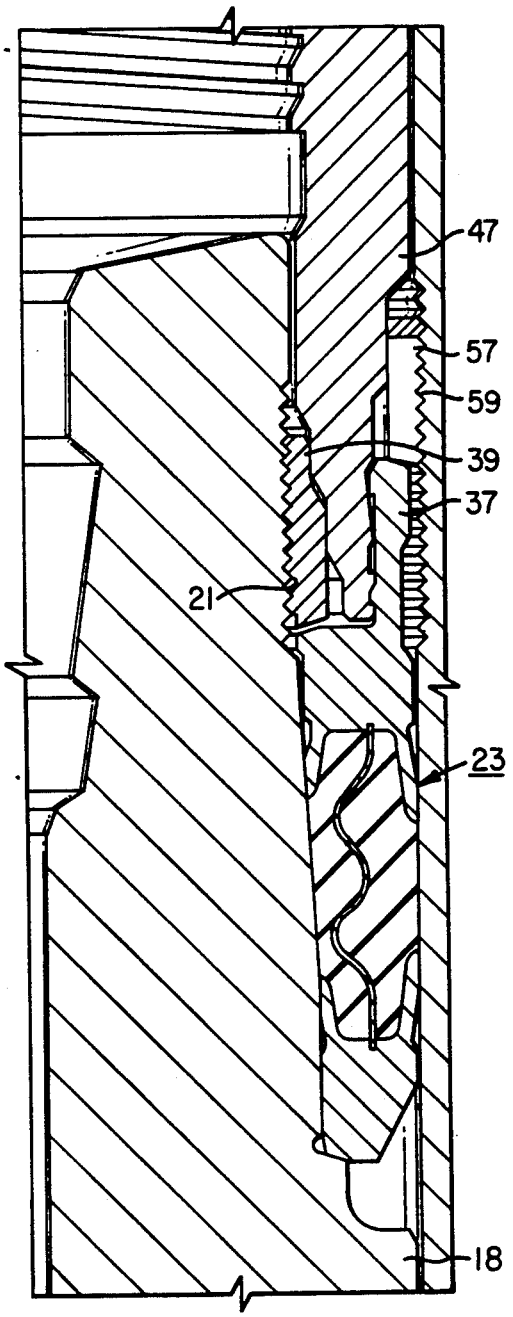
FIG. 2 is a vertical sectional view of the locking mechanism of FIG. 1, shown in the locked position.
Figure 3:
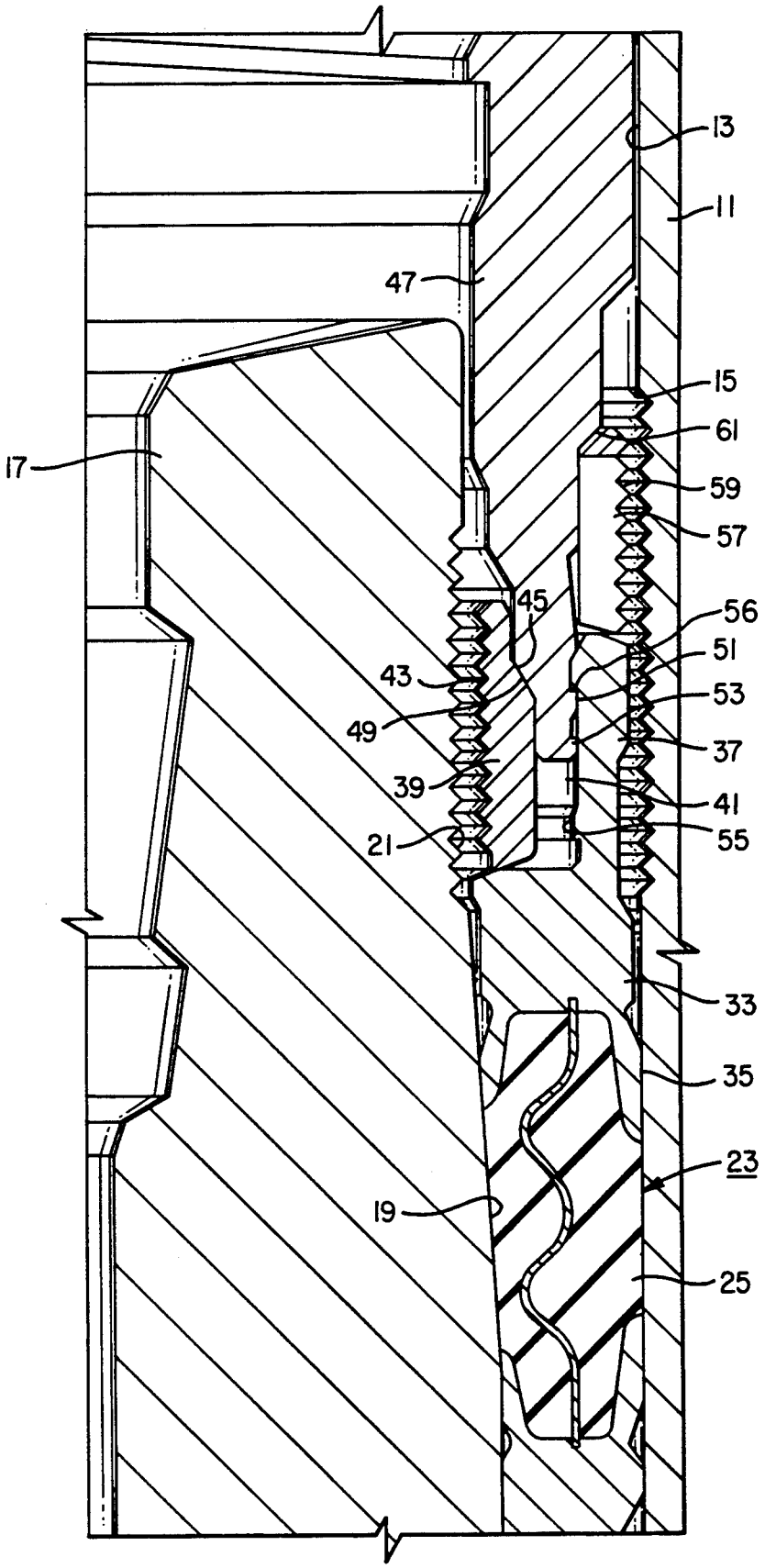
FIG. 3 is a partial enlarged vertical sectional view of the mechanism, also shown in an unlocked position.

Referring also to FIG. 3, the interior of lower split ring 39 has an upward facing tapered load shoulder 45. Shoulder 45 is conical and locates slightly below the upper end of the locking wall 37. Split ring 39 will move from its unlocked position, shown in FIG. 1, to a contracted locked position shown in FIG. 2. The natural bias of the split ring 39 will cause it to spring outward to the unlocked position unless pushed radially inward.

An energizing ring 47 mounts to the seal member 23. Energizing ring 47 has a lower end which is positioned in the channel 41. Energizing ring 47 has a downward facing load shoulder 49 on its inner diameter that is of the same taper and dimension as the upward facing shoulder 45. While the energizing ring 47 is in the upper position, as shown in FIG. 1, the downward facing shoulder 49 will be in contact with the upward facing shoulder 45. While moving to the lower position, the downward facing shoulder 49 will slide past the upward facing shoulder 45.

The shoulders 45, 49, and the thickness of the lower split ring 39 are selected so that a substantial downward force is required in order to contract split ring 39 and move the shoulder 49 out of engagement with the shoulder 45. The downward force required is less than the force required to set the elastomeric seal 25. When downward force is initially applied to the energizing ring 47 while it is in the upper position shown in FIG. 1, the downward force will transmit through the shoulders 49, 45, through the lower split ring 39, and into the upper ring 33. This downward force moves the upper ring 33 downward and deflects the sealing lips 29, 35 outward.

Referring to FIG. 3, the locking wall 37 has means for locking the energizing ring 47 in the lower position shown in FIG. 2. This includes a pair of upward facing detent shoulders 51, 53 formed on the lower end of the energizing ring 47. Shoulders 51, 53 are parallel and spaced apart from each other, defining a recess between them. A locking band or detent shoulder 55 protrudes inward from the interior side of the locking wall 37. Shoulder 55 is positioned to locate in the recess between the shoulders 51, 53 when the energizing ring 47 moves to the lower position shown in FIG. 2.

The dimension of the lower portion of energizing ring 47, and of the shoulders 51, 53, 55, cause the shoulder 53 to interfere with the shoulder 55 during this downward movement. The interference requires a substantial force on the energizing member 47 in order to cause the shoulder 53 to snap past the shoulder 55. This interference, however, is not sufficient to cause permanent deformation of the lower portion of the energizing ring 47 nor the locking wall 37. Rather, the interference results in an elastomeric yielding of the interfering members during this movement.

Referring to FIG. 3, a downward facing shoulder 56 protrudes from the interior side of the locking wall 37 near its upper end. The detent shoulder 51 will contact shoulder 56 when the energizing ring 47 is pulled upward. This applies an upward force to the seal member 23 to remove it.

The assembly also includes an upper split ring 57. Split ring 57 locates on the upper edge or rim of the lo locking wall 37. Split ring 57 preferably has alternating cuts (not shown) in the upper and lower sections so that it will expand fairly easily from the contracted position shown in FIG. 1 to the expanded position shown in FIG. 2. The natural bias of split ring 57 causes it to retract to the position shown in FIGS. 1 and 3 unless pushed outward by the energizing ring 47.

Upper split ring 57 has a plurality of serrations 59 on its outer diameter for engaging the wellhead housing serrations 15. The energizing ring 47 has a downward facing shoulder 61. Shoulder 61 bears against an upper edge of the upper split ring 57 when the split ring 57 is in the retracted position. When the energizing ring 47 moves downward, the shoulder 61 will slide downward past the upper edge of the upper split ring 57. A larger diameter section of the energizing ring 47 above shoulder 61 pushes the upper split ring 57 radially outward. The larger diameter section serves as a backup to hold the split ring 57 in the expanded position. However, there is no prestressing occurring in a radial direction while in the position shown in FIG. 2. Rather, there will be a slight clearance in the engagement of the serrations 59 With the wellhead housing serrations 15.

In operation, the casing hanger 17 will be installed in a conventional manner. A running tool (not shown) will engage the energizing ring 47 conventionally. The running tool will lower the seal member 23 without rotation into the space between the casing hanger 17 and the wellhead housing bore 13. The weight on the running tool will be transmitted through the energizing ring 47 and lower split ring 39 to the upper ring 33. This downward force will force the seal member 23 downward by wedging it between the seal surface 19 and bore 13. When the lowermost position, the lower ring 27 will contact the shoulder 20. Continued downward force on the energizing ring 47 causes a seal to be formed by the elastomeric seal 25 and by the sealing lips 29, 35.

Continued downward movement after the sealing of the elastomeric seal 25 forces the energizing ring shoulder 49 to slide downward past the lower split ring shoulder 45. This causes the lower split ring 39 to move radially inward. The serrations 43 will engage the serrations 21. Continued downward movement of the energizing ring 47 then causes the shoulder 53 to snap past the shoulder 55, locating the shoulder 55 between the shoulders 51, 53. This locks the energizing ring 47 in the lower position. The locking wall 37 will not deflect outward and will not contact the serrations 15.

During the downward movement, the upper split ring 57 will also move radially in a direction opposite to the lower split ring 39. The energizing ring 47 will move the upper split ring 57 outward, causing its serrations 59 to engage the bore serrations 15. This locks the seal member 23 to the wellhead housing 11. The lower split ring 39 will lock the seal member 23 to the casing hanger 17.

If it is desired to remove the seal member 23, a retrieving tool (not shown) will move the energizing ring 47 upward. Once sufficient force has been applied, the shoulder 53 will slide past the shoulder 55. The lower split ring 39 will expand outward to its retracted position shown in FIG. 1. The upper split ring 57 will contract inward to the retracted position shown in FIG. 1. The energizing ring shoulder 51 will contact the locking wall shoulder 56. This engagement will cause the seal member 23 to move upward. The linking section 31 will cause the elastomer 25 and the lower ring 27 to move upward as the upper ring 33 moves upward.

The invention has significant advantages. The serrations in the two split rings allow the packoff to be set without the need for extremely high forces and complex running tools. No rotation is required to set the seal member. The split rings allow the seal member to be easily retrieved. The load shoulders on the energizing ring and lower split ring assure that the seal member sets before the locking split rings actuate. The detent shoulders lock the energizing ring in the lower position.

While the invention has been shown in only one of its forms, it should be apparent to those skilled in the art that it is not so limited, but is susceptible to various changes without departing from the scope of the invention.

We claim:

1. For use in a well having a wellhead housing with a bore therethrough for supporting a casing hanger, the casing hanger having a wall surface located above an annular band and spaced inward from a wall surface in the bore, an improved casing hanger seal for sealing the wall surfaces between the casing hanger and the wellhead housing, comprising in combination:

a seal member, having a seal section which is adapted to be compressed between the wall surfaces;

a rigid locking wall joined to and extending upward from the seal member;

a split ring radially separated from the locking wall; and an energizing ring mounted for downward movement between the locking wall and the split ring in sliding contact with the split ring to move the split ring radially into engagement with one of the wall surfaces to lock the seal member in place.

2. In a well having a wellhead housing with a bore therethrough for supporting a casing hanger, the casing hanger having a wall surface located above an annular band and spaced inward from a wall surface in the bore, an improved means for sealing the wall surfaces between the casing hanger and the wellhead housing, comprising in combination:

a set of anchoring serrations formed on one of the wall surfaces;

a seal member, having a seal section which is compressed between the wall surfaces below the anchoring serrations;

a locking wall carried by the seal member and extending upward from the seal section;

a split ring carried by the seal member and radially separated from the locking wall;

a set of locking serrations formed on the split ring; and an energizing ring positioned for downward movement between the split ring and the locking wall for sliding contact with the split ring to move the split ring radially, causing at least some of the locking serrations to engage at least some of the anchoring serrations to lock the seal member in place.

3. In a well having a wellhead housing with a bore therethrough for supporting a casing hanger, the casing hanger having a wall surface spaced inward from a wall surface in the bore, an improved means for sealing the wall surfaces between the casing hanger and the wellhead housing, comprising in combination:

a set of anchoring serrations formed on at least one of the wall surfaces;

a seal member, having a seal section which is compressed between the wall surfaces below the anchoring serrations;

a locking wall extending rigidly upward from the seal member;

a split ring carried by the seal member radially separated from the locking wall, the split ring having an interior side and an exterior side, the interior side facing the locking wall;

a set of locking serrations formed on the exterior side of the split ring;

an energizing ring mounted for downward movement from an upper position to a lower position in sliding engagement with the locking wall and the interior side of the split ring to move the split ring radially, causing at least some of the locking serrations to engage at least some of the anchoring serrations to lock the seal member in place; and load means for causing a downward force imposed on the energizing ring while in the upper position to transmit through the split ring to set the seal member before the split ring moves radially, then once the seal member has set, to allow the energizing ring to move downward relative to the split ring to move the split ring radially, the load means comprising a tapered upward facing shoulder formed on the interior side of the split ring and a tapered downward facing shoulder formed on the energizing ring for mating with the upward facing shoulder of the split ring while the energizing ring is in the upper position.

4. In a well having a wellhead housing with a bore therethrough for supporting a casing hanger, the casing hanger having a wall surface spaced inward from a wall surface in the bore, an improved means for sealing the wall surfaces between the casing hanger and the wellhead housing, comprising in combination:

a set of anchoring serrations formed on at least one of the wall surfaces;

a seal member, having a seal section which is compressed between the wall surfaces below the anchoring serrations;

a locking wall extending rigidly upward from the seal member;

a split ring having an interior side and an exterior side, the split ring being radially spaced from the locking wall;

a set of locking serrations formed on the exterior side of the split ring;

an energizing ring mounted for movement between an upper position and a lower position in sliding engagement with the locking wall and the interior side of the split ring to move the split ring radially, causing at least some of the locking serrations to engage at least some of the anchoring serrations to lock the seal member in place; and locking means for locking the energizing ring in the lower position, comprising a downward facing detent shoulder formed on the interior side of the wall and an upward facing detent shoulder formed on the energizing ring for engaging the downward facing detent shoulder while the energizing ring is in the lower position, the upward and downward facing detent shoulders being positioned to interferingly engage each other as the energizing ring moves to the lower position.

5. In a well having a wellhead housing with a bore therethrough for supporting a casing hanger, the casing hanger having a wall surface spaced inward from a wall surface in the bore, an improved means for sealing the wall surfaces between the casing hanger and the wellhead housing, comprising in combination:

a set of anchoring serrations formed on at least one of the wall surfaces;

a seal member, having a seal section which is compressed between the wall surfaces below the anchoring serrations;

a locking section on the seal member located above the seal section, the locking section having a locking wall extending rigidly upward from the seal member and having a split ring, the split ring having an interior side and an exterior side;

a set of locking serrations formed on the exterior side of the split ring;

an energizing ring mounted to the locking section for downward movement from an upper position to a lower position in sliding engagement with the locking wall and the interior side of the split ring to move the split ring radially, causing at least some of the locking serrations to engage at least some of the anchoring serrations to lock the seal member in place;

a tapered upward facing load shoulder formed on the interior side of the split ring and a tapered downward facing load shoulder formed on the energizing ring for mating with the upward facing shoulder of the split ring while the energizing ring is in the upper position, causing a downward force imposed on the energizing ring while in the upper position to transmit through the split ring to set the seal member before the split ring moves radially, then once the seal member has set, to allow the energizing ring to move downward relative to the split ring to move the split ring radially; and a downward facing detent shoulder formed on the locking wall and an upward facing detent shoulder formed on the energizing ring for engaging the downward facing detent shoulder while the energizing ring is in the lower position to lock the energizing ring in the lower position, the upward and downward facing detent shoulders being positioned to cause the upward facing detent shoulder to interferingly slide past the downward facing detent shoulder as the energizing ring moves to the lower position.

6. In a well having a wellhead housing with a bore therethrough for supporting a casing hanger, the casing hanger having a wall surface spaced inward from a wall surface in the bore, an improved means for sealing the wall surfaces between the casing hanger and the wellhead housing, comprising in combination:

a set of anchoring serrations formed on each of the wall surfaces;

a seal member, having a seal section which is compressed between the wall surfaces below the anchoring serrations;

a locking wall extending rigidly upward from the seal member;

a lower split ring carried by the seal member radially spaced from the locking wall;

an upper split ring carried on top of the locking wall;

a set of locking serrations formed on each of the split rings; and an energizing ring mounted to the seal member, having a lower section located between the locking wall and the lower split ring, and with the upper split ring located on an opposite side of the energizing ring from the lower split ring, the energizing ring being movable downward in sliding contact with each of the split rings to move the split rings radially in opposite directions, causing at least some of the locking serrations of one of the split rings to engage at least some of the anchoring serrations of the casing hanger, and at least some of the locking serrations of the other of the split rings to engage at least some of the locking serrations of the wellhead housing to lock the seal member in place.

7. In a well having a wellhead housing with a bore therethrough for supporting a casing hanger, the casing hanger having a wall surface spaced inward from a wall surface in the bore, an improved means for sealing the wall surfaces between the casing hanger and the wellhead housing, comprising in combination:

a set of anchoring serrations formed on each of the wall surfaces;

a seal member, having a seal section which is compressed between the wall surfaces below the anchoring serrations;

a locking wall extending rigidly upward from the seal member, having an interior side;

a lower split ring carried by the seal member radially spaced from the locking wall, the lower split ring having an interior side facing the interior side of the locking wall;

an upper split ring carried on top of the locking wall;

a set of locking serrations formed on the each of the split rings;

an energizing ring mounted to the seal member, having a lower section located between the locking wall and the lower split ring, and with the upper split ring located on an opposite side of the energizing ring from the lower split ring, the energizing ring being movable downward in sliding contact with each of the split rings to move the split rings radially in opposite directions, causing the locking serrations of one of the split rings to engage the anchoring serrations of the casing hanger, and the locking serrations of the other of the split rings to engage the locking serrations of the wellhead housing to lock the seal member in place;

a tapered upward facing load shoulder formed on the interior side of the lower split ring and a tapered downward facing load shoulder formed on the energizing ring for mating with the upward facing load shoulder of the lower split ring while the energizing ring is in the upper position, causing a downward force imposed on the energizing ring while in the upper position to transmit through the split ring to set the seal member before the lower split ring moves radially, then once the seal member has set, to allow the energizing ring to move downward relative to the lower split ring to move the lower split ring radially; and a downward facing detent shoulder formed on the interior side of the locking wall and an upward facing detent shoulder formed on the energizing ring for engaging the downward facing detent shoulder while the energizing ring is in the lower position to lock the energizing ring in the lower position, the upward and downward facing detent shoulders being positioned to cause the upward facing detent shoulder to interferingly slide past the downward facing detent shoulder as the energizing ring moves to the lower position.

* * * * *

UNITED STATES PATENT AND TRADEMARK OFFICE

CERTIFICATE OF CORRECTION

PATENT NO. : 5,060,724

DATED : 10/29/91

INVENTOR(S) : Norman Brammer, et al.

It is certified that error appears in the above-identified patent and that said Letters Patent is hereby corrected as shown below:

On title page, item [73]

The assignee is changed from "Abb Vetco Gray Inc." to --ABB Vetco Gray Inc.--;

In the abstract, line 10, "shoudlers" is changed to --shoulders--;

At column 4, line 11, "lo" is deleted;

At column 4, line 34, "With" is changed to--with--.

Signed and Sealed this

Third Day of August, 1993

*Attest:*

Michael K. Kirk

MICHAEL K. KIRK

*Attesting Officer*

*Acting Commissioner of Patents and Trademarks*